US005095567A

United States Patent [19]

Kenoyer

[11] Patent Number: 5,095,567

[45] Date of Patent: Mar. 17, 1992

[54] BABY BACK SUPPORT

[76] Inventor: Mary L. Kenoyer, 17540 Foothill Cir., Salinas, Calif. 93908

[21] Appl. No.: 759,271

[22] Filed: Sep. 13, 1991

[51] Int. Cl.[5] ..... A47C 27/00; A47D 13/00

[52] U.S. Cl. ..... 5/655; 5/432; 297/464

[58] Field of Search ..... 5/432, 431, 436, 437, 5/434; 297/467, 465, 464

[56] References Cited

U.S. PATENT DOCUMENTS

| | | | |
|---|---|---|---|
| 1,322,292 | 11/1919 | Claus | 5/432 |
| 2,405,505 | 7/1946 | Knecht | 5/432 |
| 2,710,052 | 6/1955 | Witmer | 297/468 |
| 3,840,916 | 10/1974 | Jennings | 5/432 |
| 4,796,315 | 1/1989 | Crew | 5/431 |
| 4,980,937 | 1/1991 | Mason et al. | 5/432 |

FOREIGN PATENT DOCUMENTS

| | | | |
|---|---|---|---|
| 2379268 | 9/1978 | France | 5/431 |

*Primary Examiner*—Alexander Grosz
*Attorney, Agent, or Firm*—Davis & Schroeder

[57] ABSTRACT

An wearable, light weight infant supporting device to aid in learning to sit. The device consists of a triangular cross section pillow-like back support and attaching straps for snugly securing the back support to the infant. The back support is placed at the rear of the seated infant, the straps are routed under the infant's legs, across the stomach and fastened to the opposite end of the back support.

9 Claims, 2 Drawing Sheets

BABY BACK SUPPORT

TECHNICAL FIELD

The present invention relates generally to infant support devices and more specifically aids for allowing infants to sit upright by themselves.

BACKGROUND ART

As infants progress through various stages of development, they commonly learn to turn sit and crawl at about the same time. This typically occurs at about 5 to 7 months of age. During this time they require frequent assistance from adults to avoid falling or toppling over with potentially injurious results. This need for assistance demands constant attention by the adult and precludes participation in other activities or even a moment of inattention without sacrificing some safety for the infant. This time intensive requirement has spurred the use of mechanical aids to support the infant. The most commonly used of these is a pillow or pillows to surround the infant, providing some support and softening the fall when the infant topples over. The use of pillows, however, confines the infant to one spot while providing minimal sitting assistance.

U.S. Pat. No. 3,840,916 (Jennings) discloses an inflatable cushion that surrounds the infant, grasping the infant with arms and supporting the infant in the same manner as if the infant were sitting in someone's lap. The device disclosed by Jennings securely holds an infant upright in one spot, allowing the infant to play or observe activities in the local area. Jennings does not, however, allow the infant to crawl or move about or to another location and then resume the sitting position. Thus, Jennings effectively anchors the infant in one location until the attendant adult intervenes.

U.S. Pat. No. 4,980,937 (Mason et al.) discloses a ring-shaped device into which an infant is placed in a sitting position. The upright walls of the device support the infant and the ring structure surrounds the infant with soft resilient material to cushion the infant should he or she topple over. Mason, however, also anchors the infant at one location until the infant is moved by the attendant adult.

Another approach for supporting and confining children is disclosed in U.S. Pat. No. 4,676,554 (Harlick et al.). Harlick utilizes a chair to provide the supporting structure and restrains the child with ties. This approach again confines the child to one location and, further, may not be suitable for infants just learning to sit up.

Other supporting methods are disclosed in the art, such as U.S. Pat. Nos. 3,680,917 (Harris) and 3,889,797 (Gunst) for example. Both Harris and Gunst utilize inflatable structures for use in sitting or reclining, but neither suggest nor teach how such devices may be appropriate for use by infants at the stage of learning to sit up.

Another approach to supporting infants is "Boppy" disclosed in a mail order catalog entitled the *Right Start Catalog*, dated February, 1991. Boppy is a crescent-shaped, pillow device in which an infant may be placed and is the subject of a pending patent application assigned to Camp Kazoo, Denver, Colo., 80209.

Boppy partially surrounds an infant with a supporting pillow higher at the back than at the sides and open at the front. This allows the infant to sit up and also to crawl out of the front should the infant be able to crawl.

Boppy however, does not assist the infant in resuming a sitting position at another location unless an attendant adult relocates the device and assists the infant in resuming a sitting position. Boppy is neither attached to the infant nor easily transportable by an attending adult.

DISCLOSURE OF INVENTION

A baby back support according to the present invention is a balancing aid for an infant who is learning to sit in an upright position. The baby back support provides strategic hip-level support which is needed by the baby at this stage of development. With support at the hips the baby is free to move the torso, thereby developing muscular strength and control of the torso.

The present invention consists of a shaped, flat-bottomed, belt-like pillow device which is snugly fastened around the infant at the hips, with the device at the rear. This provides a significant increase in the support area in contact with the floor, decreasing the potential of tipping over in a backward direction.

The baby back support provides a nonconfining support for the infant. As the infant increases in ability to crawl, the infant will alternately sit and crawl in response to his or her desires and ability. The back support is attached to the infant and therefore allows the infant to resume a sitting position at a new location, within the limits of sitting development. This allows the infant the freedom to explore, reach toys and exercise without restraint.

The baby back support of the present invention is placed on the infant with straps which are secured to the back support at one end, brought under the infant's legs, across the lower stomach and attached to the back of the back support at the opposite end with suitable attaching devices such as Velcro or snaps. The baby back support is thus easily attached and removed from the infant.

The present invention may be constructed of washable materials to facilitate cleaning. The back support may be constructed in several sizes to accommodate differences in infants. The back support compartments may be filled with light-weight materials such as air, solid beads such as styrofoam or polystyrene, gel or fibrous materials such as pillow stuffing.

BRIEF DESCRIPTION OF DRAWINGS

For fuller understanding of the present invention, reference is made to the accompanying drawing in the following detailed Description of the Preferred Embodiment of the invention. In the drawing.

Figure 1:
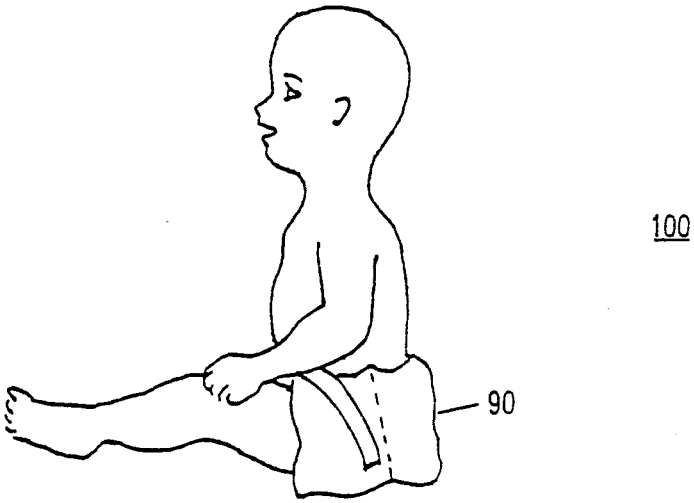
FIG. 1 is a perspective view of the preferred embodiment of the present invention being worn by an infant.

Reference numbers used in the drawing refer to the same or equivalent parts of the present invention throughout the several figures of the drawing.

BEST MODE OF CARRYING OUT THE INVENTION

Figure 2:
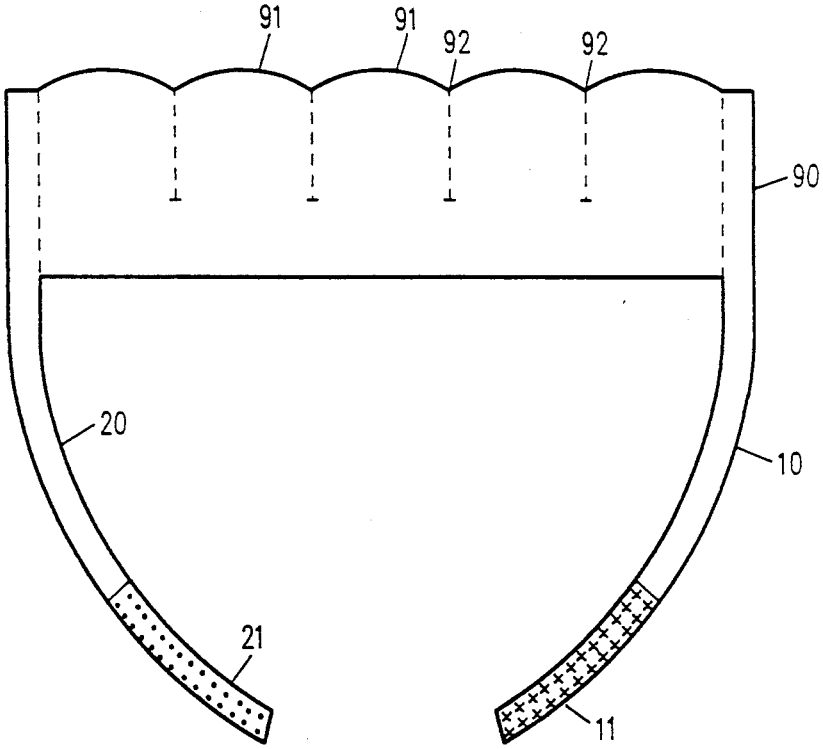
FIG. 2 is a front view of the preferred embodiment shown in FIG. 1.

Referring now to FIGS. 1 and 2, the present invention is shown. Baby back support 100 consists of a body which is a pillow-like back support 90, and attaching straps 10 and 20. In the preferred embodiment a triangular cross section of the back support is illustrated in the following description. Other shapes such as rectangular or semicircular cross sections may also be utilized.

In the preferred embodiment, one end of strap 10 is attached to one end of back support 90, and one end of strap 20 is attached to the opposite end of back support 90, each strap extending from the bottom of back support 90 toward the front of back support 90.

Straps 10 and 20 extend typically 18 inches from the front of back support 90 and are typically one inch wide. Readily available materials such as webbing, belting or fibrous strapping are preferred. Attachment of straps 10 and 20 is typically by sewing of straps 10 and 20 to the material of which back support 90 is made. Alternative attaching methods such as gluing, or heat welding as determined suitable for the construction materials, may be utilized, as may detachable methods such as snaps, buttons, Velcro or the like. The unattached ends of straps 10 and 20 are removably attached to back support 90 as described hereinbelow.

Baby back support 100 is typically constructed of easily cleaned materials such as cotton cloth, vinyl covered cloth or reinforced vinyl material. If the material to be used for stuffing is air, gelatinous or finely textured, an impervious material must be chosen for construction. The choice of materials is based on ease of cleaning and lightness for ease of transportation.

Back support 90 is of triangular shaped cross section, typically 4 inches at the base and 6 inches high. Back support 90 is divided along its length into an odd number of compartments 91, typically five in number but three or seven compartments may be utilized to accommodate different infant sizes. Alternatively, the dimensions of back support 90 may vary to accommodate different infant sizes. An odd number of compartments is preferred so that one compartment is centered at the infant's spine for maximum support.

Referring now to FIGS. 2 through 7, the construction of back support 90 is shown. Base 40 forms the flat bottom of back support 90 and is typically 22 inches in length and four inches wide. These and other dimensions described herein may be varied to accommodate other sizes of the present invention.

Figure 3:
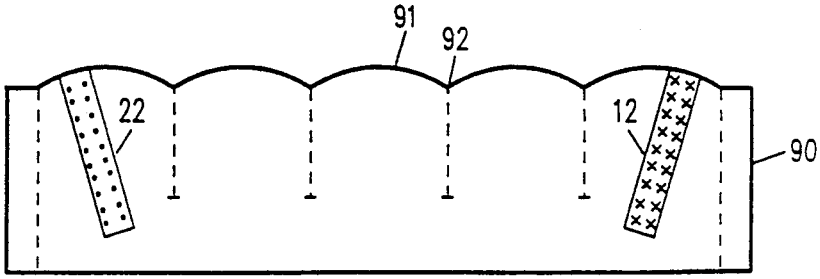
FIG. 3 is a rear view of the preferred embodiment shown in FIG. 1.
Figure 4:
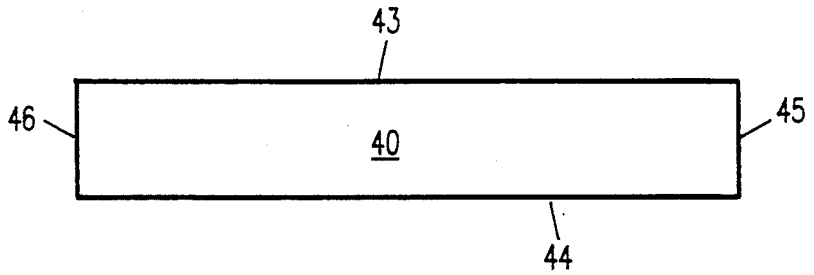
FIG. 4 is a plan view of the cut pattern for the base of the preferred embodiment shown in FIG. 1.
Figure 5:
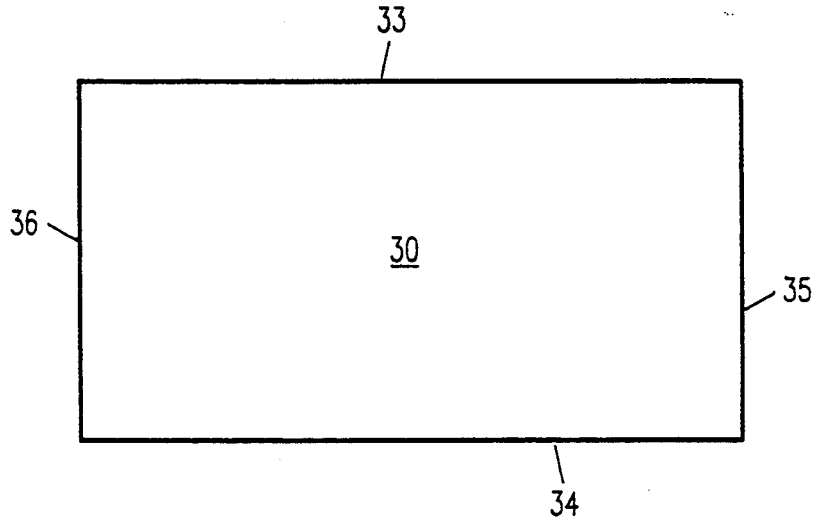
FIG. 5 is a plan view of the cut pattern for the body of the embodiment shown in FIG. 1.

Straps 10 and 20 are then attached to base 40 as described hereinabove. Suitable lengths of hook and loop type fastener material, such as the one sold under the trademark of Velcro, 12 and 22 are then sewn to body 30 near each end of body 30. Material 12 and 22 is attached at an angle relative to the vertical dimension of the finished back support, typically 15 degrees off of vertical and oriented toward the bottom center as shown in FIG. 3.

Rectangular shaped body 30 is sewn to base 40, edge 33 to edge 43 and edge 34 to edge 44, forming a tubular structure, which when completed will comprise back support 90.

One triangular end piece 50 is then sewn onto ends 45 and 35 of base 40 and body 30 respectively, and another triangular end piece 50 is then sewn onto end 46 of base 40 and end 36 of body 30. One of the end seams is left unfinished for inversion of the back support and addition of the filling materials in a manner well known in the art.

Back support 90 is then inverted so that the seams are inside and the exterior of back support 90 is free of protrusions, except for straps 10 and 20 and Velcro hook material pieces 12 and 22 as described hereinabove.

Figure 6:
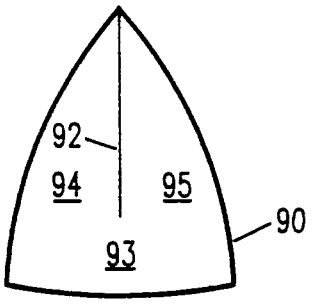
FIG. 6 is an inner detail of one compartment of the body of the embodiment of FIG. 1.
Figure 7:
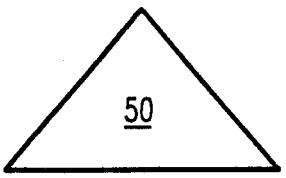
FIG. 7 is a plan view of one end piece with which the baby back support is constructed.

Back support 90 is divided into compartments 91 by stitching seams 92 approximately two-thirds of the height of back support 90, measured from the top. Leaving the remainder of the back support unstitched provides communication between compartments 91 to facilitate filling of compartments 91 with the materials chosen to fill back support 90. FIG. 6 is an inner view detail of seam 92 showing communicating space 93 between regions 94 and 95 of a compartment.

The formation of compartments 91 facilitates wrapping the baby back support around the infant's torso by creating hinge-like joints at seams 92 between said compartments.

Straps 10 and 20 are then finished by attaching a suitable length of Velcro loop material 11 and 21 to the free or unattached end of each strap. Velcro is the preferred attaching method as it permits one-handed attachment and disengagement. Alternative attaching methods such as snaps, buttons or other devices as are known in the art may be used.

Back support 90 is typically firmly filled with fibrous pillow stuffing material, for example polyester or Dacron fibre. Alternative filling materials may be small styrofoam or polystyrene beads, air, a gelatinous material or perhaps more dense materials such as sand. Use of heavier materials results in sacrifice of transportability but may be desirable in some circumstances. The preferred filling material is fibrous pillow stuffing; beads are less desirable because of the potential for ingestion by the infant should any stuffing material escape.

The present invention has been particularly shown and described with respect to certain preferred embodiments thereof. However, it should be readily apparent to those of ordinary skill in the art that various changes and modifications in form and details may be made without departing from the spirit and scope of the invention as set forth in the appended claims.

I claim:

1. An infant support device adapted to be releasably fastened around the hips of an infant, comprising:

a back support comprising a generally flat-bottomed, belt-like pillow device;

two straps, one end of the first said strap securely attached to one end of said back support and the other end of first said strap remaining unattached, one end of the second said strap securely attached at the opposite end of said back support and the other end of second said strap remaining unattached, both said straps attached at the lower edge of said back support; and attaching means for removably attaching each said unattached end of each of said straps to said back support.

2. A device as in claim 1 wherein said back support has a triangular cross section.

3. A device as in claim 1 wherein said back support has a rectangular cross section.

4. A device as in claim 2 wherein said back support has a long dimension greater than the height of said triangular cross section.

5. A device as in claim 3 wherein said back support has a long dimension greater than the height of said rectangular cross section.

6. A device as in claim 1 wherein said back support is divided into compartments.

7. A device as in claim 1 wherein said back support is filled with resilient material.

8. A device as in claim 1 wherein said attaching means comprise hook and loop type fastening material.

9. A device as in claim 1 wherein said attaching means comprise snaps.

* * * * *